US005337686A

United States Patent [19]

Nagata

[11] Patent Number: 5,337,686

[45] Date of Patent: Aug. 16, 1994

[54] NEEDLE PLATE APPARATUS FOR SEWING MACHINE

[75] Inventor: Yoshinobu Nagata, Chofu, Japan

[73] Assignee: Juki Corporation, Chofu, Japan

[21] Appl. No.: 79,343

[22] Filed: Jun. 18, 1993

[30] Foreign Application Priority Data

Jun. 19, 1992 [JP] Japan ..... 4-042501[U]

[51] Int. Cl.[5] ..... D05B 75/00; D05B 1/20

[52] U.S. Cl. ..... 112/260; 112/162

[58] Field of Search ..... 112/260, 121.15, 121.12, 112/258, 162

[56] References Cited

U.S. PATENT DOCUMENTS 3,145,672 8/1964 Marforio ..... 112/162

4,407,210 10/1983 Jung et al. ..... 112/260 X 4,917,032 4/1990 Matsumoto ..... 112/260 X

FOREIGN PATENT DOCUMENTS 59-13988 4/1984 Japan .

*Primary Examiner*—Clifford D. Crowder

*Assistant Examiner*—Paul C. Lewis

*Attorney, Agent, or Firm*—Morgan & Finnegan

[57] ABSTRACT

A needle plate structure for a sewing machine is disclosed, which includes a needle plate mounted on a bed extension which can be readily removed and replaced but which also permits adjustment of the alignment and registration of the bed extension and needle plate with respect to the work supporting bed of the sewing machine.

6 Claims, 3 Drawing Sheets

NEEDLE PLATE APPARATUS FOR SEWING MACHINE

BACKGROUND OF THE INVENTION

1. Field of the Invention

This invention relates to an improved cylinder bed type overlock sewing machine and, more particularly, to a needle plate structure for such a sewing machine, which is capable of so moving a throat plate transversely and longitudinally as to locate the optimum needle penetrating point.

2. Description of the Related Art

In general, flat bed type sewing machines as disclosed in U.S. Pat. No. 3,145,672 and cylinder bed type machines, as illustrated in FIG. 1, which are adapted to locate or direct the needle on or to a cylinder bracket 2 extending from one side of the sewing machine body, have been well known in the field of overlock sewing machines.

Sewing machines of this class have parts and elements arranged, assembled and adjusted so as to locate the needle N, if actuated, on a reference needle penetrating point C of a needle plate 1.

Practically speaking, the point of the needle N is, however, caused to be out of alignment with the reference needle penetrating point C when operated and in some cases the needle impinges against the needle plate 1 due to dimensional tolerances of the parts of the sewing machine and poor assembly of the machine parts. This causes poor sewn product and causes breakage in the needle. In this instance, the conventional approach has been to disassemble the sewing machine, exchange certain parts and re-adjust the position of the needle plate, thus leading to lower reliability of the sewing machine and lower sewing efficiency.

SUMMARY OF THE INVENTION

It is a prime object of the invention to provide a needle plate arrangement which enables adjustment of a needle penetrating or falling point by only adjusting the position of a needle plate and which does not require any disassembly and part exchange of the sewing machine.

Another object of the invention is to provide a needle plate apparatus which permits the needle to precisely locate or fall on the reference needle penetrating point.

Another object of the invention is to provide a needle plate mechanism which is adapted to very readily move a needle plate to so position the latter as to obtain the optimum position of the needle penetrating point.

It is a further object of the invention to provide a throat plate assembly of the foregoing character which is simple in construction, efficient in operation and economical to manufacture.

These and other objects of the invention are met by providing a needle plate structure for such a sewing machine, which comprises a needle plate having on its underside a first receptacle extending in the direction of stitching, a needle plate support having at its top a first insert to be fitted in the first receptacle, a back plate adapted to be fitted in a second receptacle formed on the underside of the needle plate support in the direction of stitching, the back plate having on its underside a third insert perpendicular to the direction of stitching, and a third receptacle formed in the upper surface of a cylinder bracket, the third insert fitting in the third receptacle so that the needle plate is firmly fastened by the needle plate support to the cylinder bracket, the needle plate support being transversely movable with respect to the back plate, that is, in the direction of stitching, the back plate being longitudinally moved in a direction perpendicular to the direction of stitching whereby the needle plate may be readily transversely and longitudinally moved to assume a position where the point of the needle is pointed to the reference needle penetrating point of the needle plate.

One embodiment of the invention will now be described by way of example, and by reference to the accompanying drawings, in which:

DETAILED DESCRIPTION OF THE DRAWINGS

Figure 1:
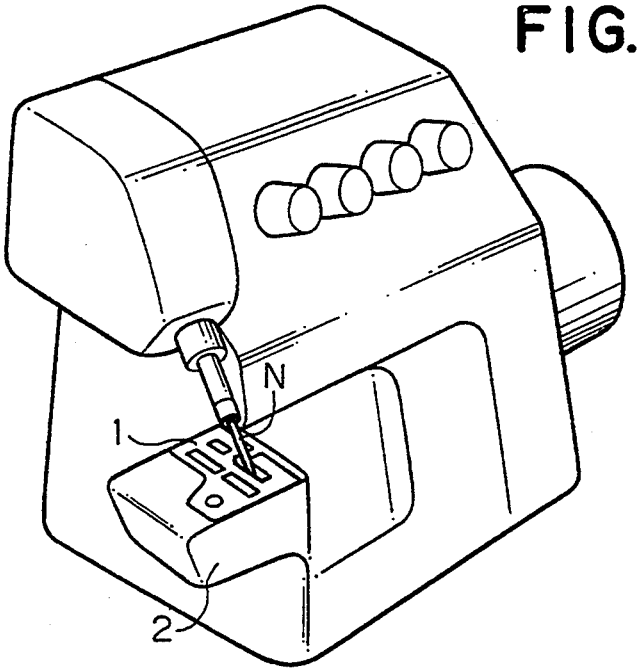
FIG. 1 is a perspective view of a cylinder bed type overlock sewing machine.
Figure 2:
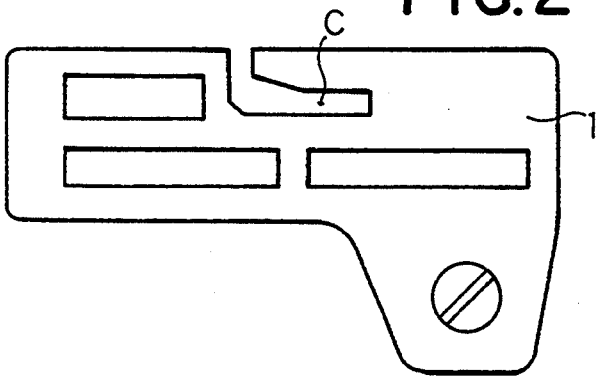
FIG. 2 is a top view showing a needle plate for use with the sewing machine shown in FIG. 1.
Figure 3:
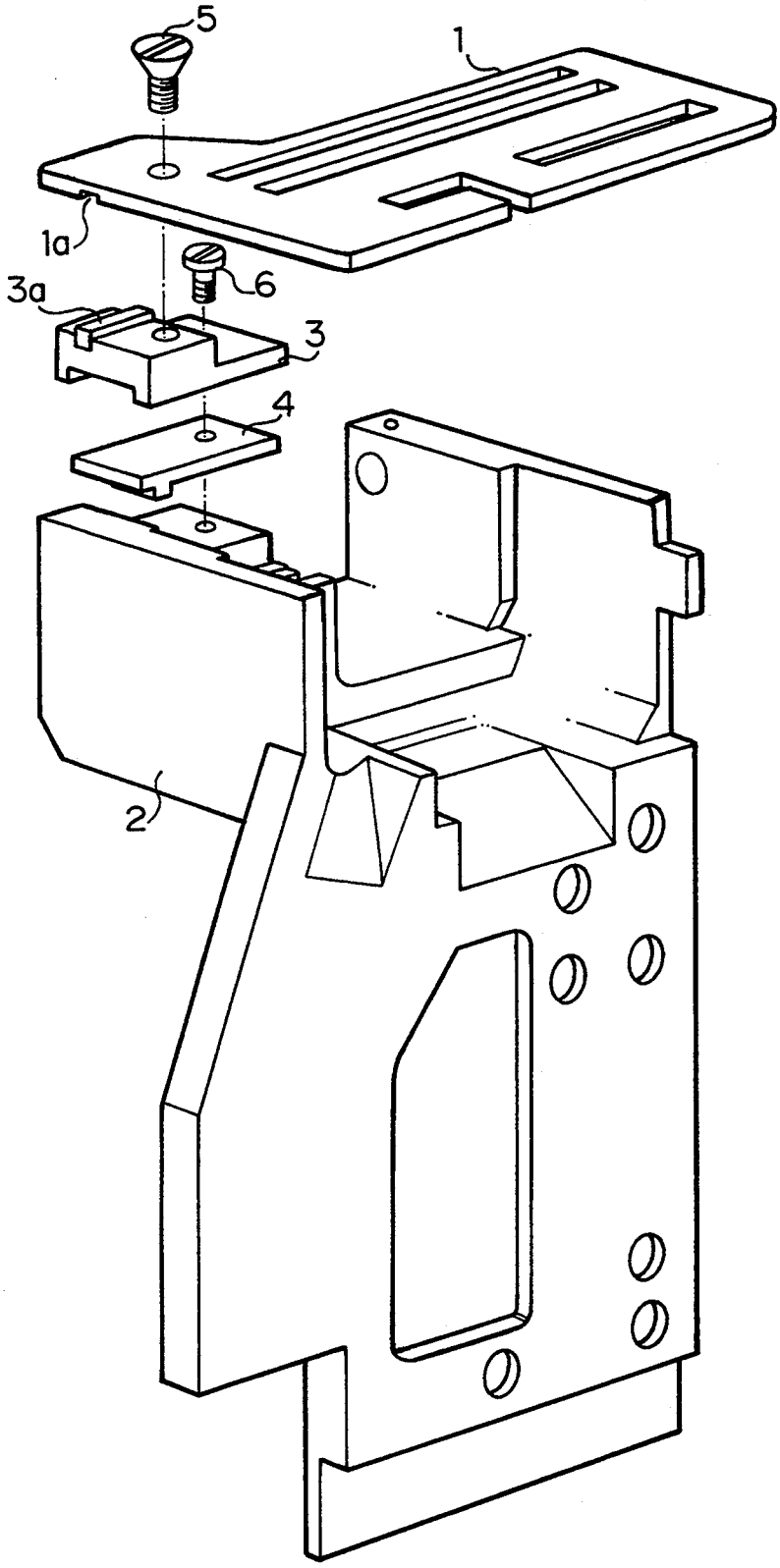
FIG. 3 is an exploded perspective view of a needle plate apparatus according to the present invention.
Figure 4:
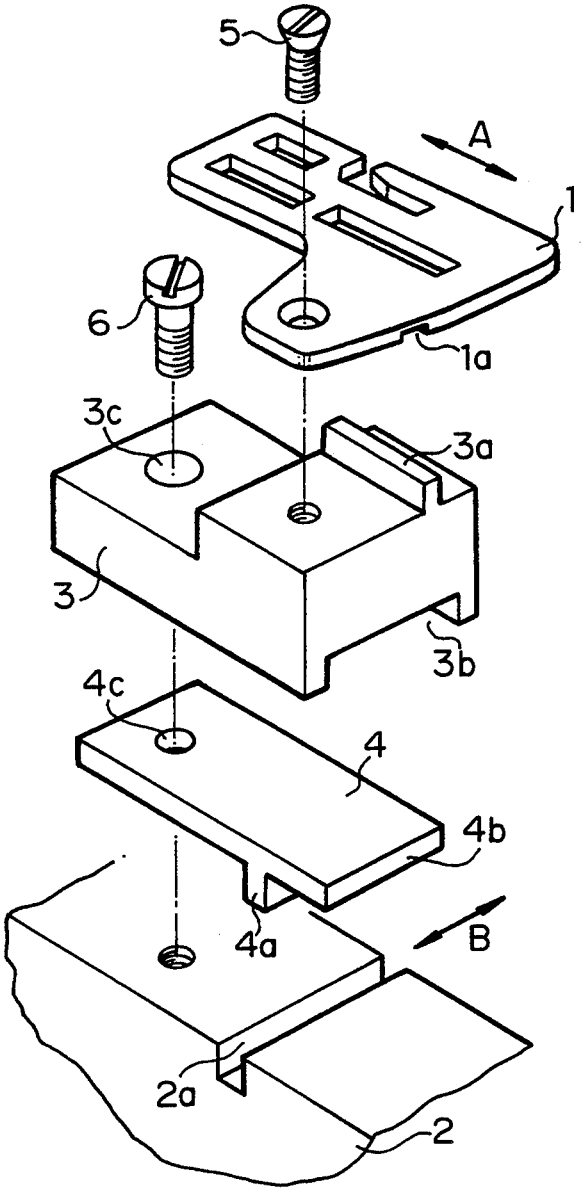
FIG. 4 is an exploded perspective view of the essential elements of the needle plate apparatus.

Referring to FIGS. 3 and 4, a needle plate 1 is mounted on a machine frame comprising a cylinder bracket 2 at the top thereof and supported or carried by a first support member comprising a needle plate support 3. The cylinder bracket 2 is part of a work supporting bed of the sewing machine. A second support member comprising a back plate 4 is rigidly mounted on the cylinder bracket 2 and adapted so that its top adjoins the needle plate support 3. The back plate 4 carries the needle plate 1 and the support 3 thereon. The needle plate support 3 and back plate 4 constitute a bed extension.

The needle plate 1 is provided on its underside with a first receptacle la extending transversely of the sewing machine and parallel to the direction of stitching. The needle plate support 3 which directly supports the needle plate 1 is formed at its top with a first insert **3*a* to fit in the first receptacle 1*a*. The support 3 includes on its underside a second receptacle 3*b* extending transversely of the sewing machine, as will be described later, to fit over the back plate 4. The first receptacle 1*a* and the first insert 3*a* are interlocked with each other to form fitting means for preventing the needle plate 1 from rotating. The structure is arranged in the instant embodiment so that the first receptacle 1*a* and the first insert 3*a* are formed on the underside of the needle plate 1 and the top of the needle plate support 3, respectively. Alternatively, the first receptacle 1*a* may be formed on the top of the needle plate support 3 with the first insert 3*a* being formed on the underside of the needle plate 1**.

A second receptacle or groove **3*b* in the form of a second contoured surface or recess is formed beneath the needle plate support 3 longitudinally thereof to receive therein a second contoured surface comprising a second insert or rail element 4*b* defined by a back plate 4 comprising a board. The second receptacle 3*b* and the second insert 4*b*** are interlocked with each other to form a second slide means or member.

The back plate or support 4 which is rigidly fixed to the top of the cylinder bracket 2 is provided with a first contoured surface having a third insert or rail element **4*a*** which is parallel to the sewing machine and perpendicular to the direction of sewing. The third insert 4*a* fits in the third receptacle or groove 2*a* formed in a first contoured surface of the cylinder bracket 2. The third insert 4*a* and the third receptacle 2*a* are interlocked with each other to define a first slide or member.

The needle plate 1 and the needle plate support 3 are firmly fastened by a screw 5 of a countersunk head type tightened thereagainst. It is to be understood that the needle plate 1 is fixed with respect to and is firmly held against the needle support plate 3 by fitting means which comprises the first receptacle 1*a* and first insert 3*a* when the screw 5 is tightened.

Numeral 6 designates a set screw or locking member which serves to tighten the needle plate support 3 and the back plate 4 against the cylinder bracket 2. The needle plate support 3 and the back plate 4 are formed with holes 3*c*, 4*c* which are somewhat larger than the shank of the screw 6 but somewhat smaller than the head of the screw 6.

In operation, for adjustment of the position of the needle plate 1, a cover is initially removed from the cylinder bracket 2 to provide access to the set screw 6 for loosening thereof. More specifically, the set screw 6 is so loosened as to urge the support 3, and needle plate 1 attached thereto in the direction of stitching (the first direction shown by arrow A of FIG. 4) so that they are moved to a very slight extent, that is, by the difference in diameter between the shank of set screw 6 and the holes 3*c*, 4*c*. Relative movement of the support 3 with respect to the back plate 4 in the direction A is facilitated by the cross sections of the second receptacle 3*b* and second insert 4*b* being constant in the direction A. The relative movement between the needle plate support 3 and the back plate 4 is limited by engagement of the shank of the set screw 6 in the holes 3*c*, 4*c* when the needle plate support 3 slides over the back plate 4. In this manner, the needle plate 1 and the needle plate support 3 may be adjustably moved until the optimum position of the needle penetration point is obtained. The set screw 6 is then tightened and the cylinder bracket 2 is covered with the cylinder cover, thus finishing the adjustment.

On the other hand, if it is desired to so adjust as to move the needle plate 1 in a direction perpendicular to the direction of A (the second direction of an arrow B of FIG. 4), a cover is initially removed from the cylinder bracket 2 to provide access to the set screw 6 for loosening thereof. More specifically, the set screw 6 is so loosened as to urge the needle plate 1, the needle plate support 3, and the back plate 4 longitudinally of the machine (in the second direction shown by arrow B of FIG. 4) so that they are all moved to a very slight extent, that is, by the difference in diameter between the shank of set screw and the holes 3*c*, 4*c*. Relative movement of the back plate 4 with respect to the cylinder bracket 2 in the direction B is facilitated by the cross sections of the third insert 4*a* and third receptacle 2*a* being constant in the direction B. The relative movement of the back plate 4 and the cylinder bracket 2 to each other is limited by engagement of the shank of the set screw 6 in the holes 3*c*, 4*c* when the back plate 4 slides over the cylinder bracket 2. In this manner, the needle plate 1, the needle plate support 3, and the back plate 4 may be adjustably moved until the optimum position of the needle penetration point is obtained. The set screw 6 is then tightened and the cylinder bracket 2 is covered with the cylinder cover, thus finishing the adjustment.

The needle plate 1 may be transversely and longitudinally moved in directions A, B, respectively, simultaneously or alternately if desired. Although the needle plate support 3 and the back plate 4 are disposed between the needle plate 1 and the cylinder bracket 2, the needle plate 1 and the needle plate support 3 may be integrally formed as a unit.

What is claimed is:

1. In an overlock sewing machine having a needle plate, a needle which is movable in an upward and downward direction so as to penetrate into a predetermined position of the needle plate, the overlock sewing machine comprising:

a first support member supported under said needle plate on a frame of said sewing machine, said first support member including first means for horizontally moving in a first direction;

a second support member on which said needle plate is directly mounted, said second support member being under said needle plate and mounted on the upper surface of said first support member, said second support member including second means for moving in a second direction perpendicular to said first direction; and a locking member for fastening said first and second support members to said machine frame in a position obtained by moving said first and second support members in said first and second directions.

2. An overlock sewing machine as described in claim 1 characterized in that said first and second support members are moved in the direction of stitching and a direction perpendicular thereto, respectively.

3. An overlock sewing machine as described in claim 1 wherein said first means comprises a first rail element and a first groove formed between said machine frame and said first support member, said first rail element being engageable in said first groove along said first direction, said second means comprising a second rail element and a second groove formed between said first and second support members, said second rail element being engageable in said second groove along said second direction.

4. An overlock sewing machine as described in claim 1 wherein said first means comprises a first contoured surface formed on an upper surface of said machine frame and on a lower surface of said first support member, said first contoured surfaces interlocking and being constant in cross section in said first direction, said second means comprising a second contoured surface formed on an upper surface of said first support member and on a lower surface of said second support member, said second contoured surfaces interlocking and being constant in cross section in said second direction.

5. An overlock sewing machine as described in claim 1 wherein said first means comprises a rail element formed on the lower surface of said first support member and a complementary groove formed on the upper surface of said machine frame, said second means comprising a rail element formed on the upper surface of said first support member and a complementary groove formed on the lower surface of said second support member.

6. An overlock sewing machine as described in claim 1 wherein said first means comprises a first member for sliding in said first direction and said second means comprises a second member for sliding in said second direction.

* * * * *